US011391534B1

(12) United States Patent
Azhocar

(10) Patent No.: US 11,391,534 B1
(45) Date of Patent: Jul. 19, 2022

(54) MODULAR CONNECTION HANDLE SYSTEM FOR FIREARM

(71) Applicant: Frederick Steven Azhocar, San Diego, CA (US)

(72) Inventor: Frederick Steven Azhocar, San Diego, CA (US)

( * ) Notice: Subject to any disclaimer, the term of this patent is extended or adjusted under 35 U.S.C. 154(b) by 0 days.

(21) Appl. No.: 17/180,742

(22) Filed: Feb. 20, 2021

(51) Int. Cl.
*F41A 23/14* (2006.01)

(52) U.S. Cl.
CPC ..... *F41A 23/14* (2013.01)

(58) Field of Classification Search
CPC ..... F41A 23/14; F41A 23/10; F41C 23/14; F41C 23/16
See application file for complete search history.

(56) References Cited

U.S. PATENT DOCUMENTS

| | | | | |
|---|---|---|---|---|
| 9,718,182 | B2 * | 8/2017 | Azhocar | B25G 3/36 |
| 11,112,208 | B1 * | 9/2021 | Mantas | F41C 23/16 |
| 2019/0072355 | A1 * | 3/2019 | Pop | F41A 23/10 |
| 2021/0180912 | A1 * | 6/2021 | Brauer | B25G 3/26 |

* cited by examiner

*Primary Examiner* — J. Woodrow Eldred
(74) *Attorney, Agent, or Firm* — Kevin Keener; Stephen Presutti

(57) ABSTRACT

A modular handle system for a firearm is disclosed. The modular handle system is comprised of several components that are interchangeable. The separate components utilize a connector and a sleeve combination to removably attach components together. The handle system may use fixed handles, pivot handles using a pivot sphere for maneuverability, tripods, or any other firearm component. The separate components may be removed and attached as desired by the user. The sleeves have internal protrusions which fix the connector in place when the connector is inserted into a cavity in the sleeve.

14 Claims, 16 Drawing Sheets

MODULAR CONNECTION HANDLE SYSTEM FOR FIREARM

PRIORITY

This application is a continuation of, and claims priority to, U.S. patent application Ser. No. 16/798,820, filed on Feb. 21, 2020, which claims priority to U.S. Provisional Patent Application Ser. No. 62/808,347, filed on Feb. 21, 2019, the disclosures of which are hereby fully incorporated by reference.

FIELD OF THE INVENTION

The invention pertains generally to firearm accessories and more particularly to a modular handle system for a firearm.

BACKGROUND OF INVENTION

The invention is directed toward a swivel handle assembly. As originally conceived the swivel handle assembly was intended for use on assault rifles. The disclosure will be written with firearms as the central focus of the utilization for the swivel handle assembly. However, it should be recognized that the firearm may be interchangeable with any tool or device and the description of the use of the swivel handle assembly on a firearm should not be seen as limiting the scope of the invention but rather as being illustrative of the use of the swivel handle assembly on a tool.

Standard assault rifles are configured to be held with both hands of a user. One hand of a user is placed on grip handle and the user can pull the trigger. The user can then utilize the non-trigger hand to hold the extended fore part of the gun. Normally, the user can support the fore part of the gun by placing the non-trigger hand under the rail section of the rifle. The rail section is configured such that additional elements and components may be attached to the rail for utilization by the user. One such additional component which a user can add on is a handle for use in the fore section of the rifle.

Standard handles which may be added to the rail are normally static, in that the handle is always extended downward from the rail in an unmovable position. Moveable handles were then implemented. These moveable handles extended downward from the rail section but could be flipped upward, in-line with the barrel, when not in use. These standard handles though are highly limited. They only provide one or two positions for users—either fully up or fully down. Additionally, these handles are only positionable in-line with the barrel of the rifle. These limitations do not take into account the preferences of the user who may want the handle in an out of line position or at a customizable angle. What is needed is a swivel handle for a firearm which is provides a full scope of rotation for the user and may be locked into any position chosen by the user.

The same problem is encountered through the use of other tools utilizing handles. Most handles on tools are fixed in a set position without regard for user preference as to the angle of the handle. What is needed for these tools is a swivel tripod providing a full scope of rotation which may be locked into a position chosen by the user.

Furthermore, what is needed is a modular handle system which permits a user to quickly and easily exchange handle parts for a firearm. For instance, what is needed is a modular system that permits a user to change a handle quickly and easily to a tripod and back.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof Its sole purpose is to present some concepts in a simplified form as a prelude to the more detailed description that is presented later.

The invention is directed toward a modular handle system for a firearm comprising a mounting component configured to be removably secured to a firearm; one or more connectors, wherein each of said one or more connectors comprise a first end and a second end; a channel disposed adjacent to said second end; wherein said second end terminates in a lip; one or more sleeves, wherein each of said one or more sleeves comprise an internal cavity; one or more internal protrusions disposed into said internal cavity wherein said one or more internal protrusions are respectively disposed in said channel of said one or more connectors when said connector is disposed in said internal cavity of said sleeve.

The modular handle system may further comprises a pivot sphere connected to a portion of said modular handle system. Said pivot sphere may be connected to said mounting component. The modular handle system may further comprise a handle connected to a portion of said modular handle system. In another embodiment said one or more connectors further comprises a connector attached to an end of said handle.

In another embodiment, one of said one or more sleeves further comprises a first sleeve attached to pivot sphere. In another embodiment a tripod is connected to a portion of said modular handle system. In another embodiment, one or more leg extensions are connected to said tripod. In another embodiment there is a stabilizer connected to a bottom portion of said tripod.

In another embodiment, a handle is connected to a portion of said modular handle system, wherein said one or more connectors further comprises a first connector having a threaded first end; wherein said mounting component has a threaded portion for receiving said threaded first end of said first connector; wherein said first connector is removably attached to said mounting component.

In another embodiment, the module handle system further comprises a side plate attached to said mounting component.

The one or more internal protrusions may further comprise ball bearings.

The invention may also be directed toward a method of reconfigurating a handle on a firearm comprising inserting a first connector into a first sleeve; removing said first connector from said first sleeve; inserting said first connector into a second sleeve; and firing said firearm.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
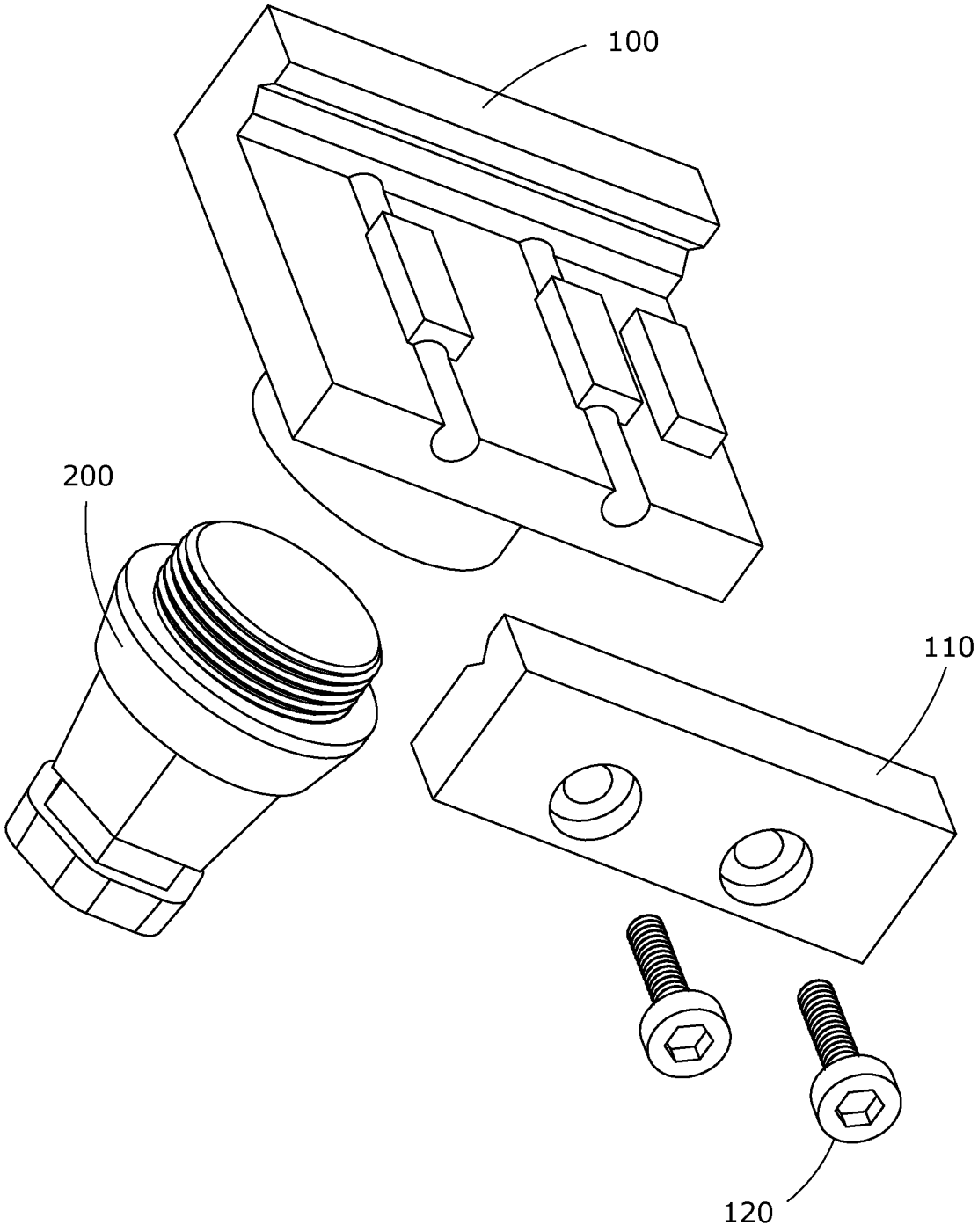
FIG. 1 is a perspective view of a modular connection system.
Figure 2:
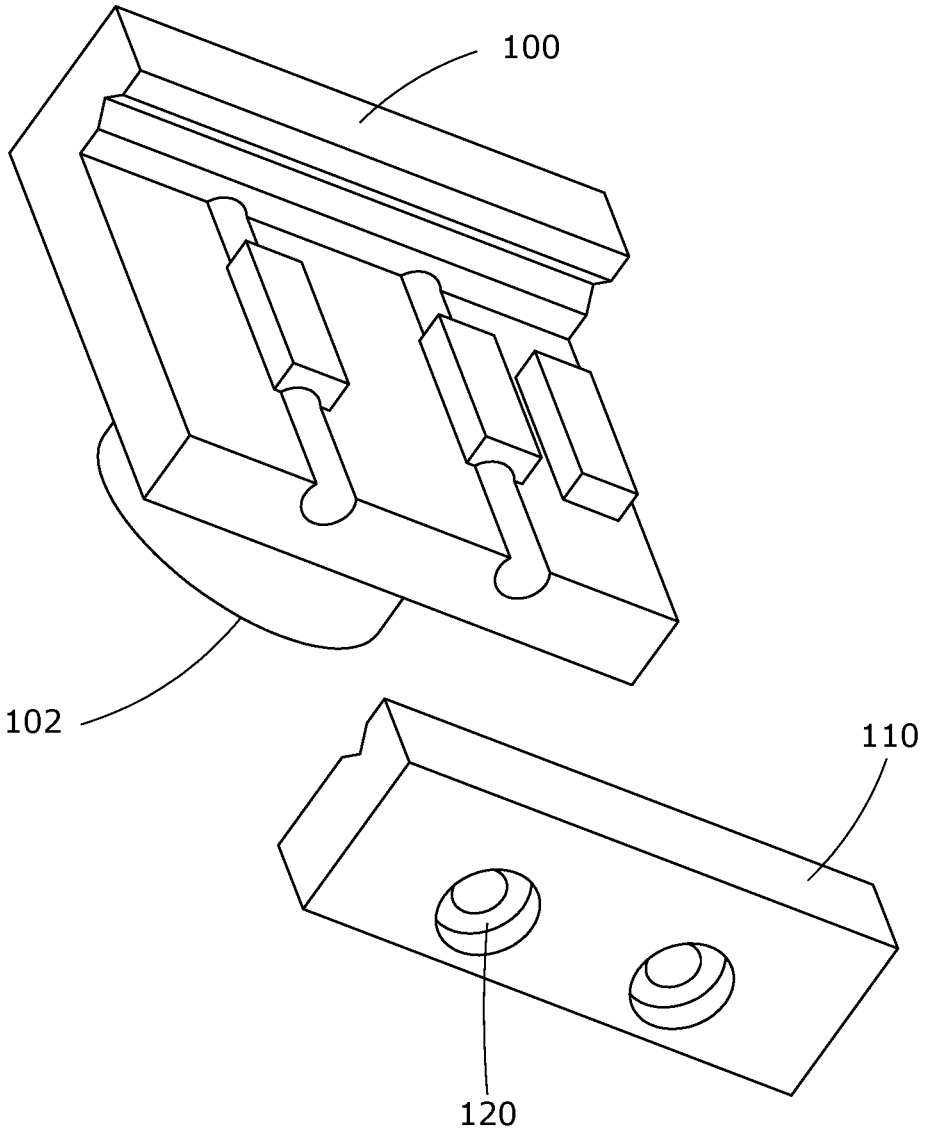
FIG. 2 is a perspective view of a mounting component.

Referring to FIG. 1, the modular connecting system is illustrated. In the preferred embodiment the modular system comprises a mounting component 100, a side plate 110, bolts 120, and a connector 200. As shown in FIG. 2, the side plate 110 is removably attached to the mounting component 100 by the bolts 120. The bolts 120 pass through the bolt holes 112 in the side plate 110 to secure into the mounting component 100. The mounting component 100, with the side plate 110, are configured to connect to the rail of a firearm. As shown in FIG. 1 and FIG. 2, the mounting component 100 is configured to attach to a picatinny rail. The mounting component 100 has a threaded channel for receiving the connector 200. As shown in FIG. 1, FIG. 2, and FIG. 5, the connector 200 has a threaded end 202 which complements the threaded channel of the mounting component 100. Thus, the connector 202 can be screwed into mounting component 100 to connect the two when a user desires and unscrewed from the mounting component 100 when a user desires to remove the unit. The mounting component 100 and side bar 110 may be any size and shape provided that the mounting component 100 secures the module system to the firearm. The connector 200 may be any size and shape. The connector 200 may removably connect to the mounting component 100 in any manner.

Figure 3:
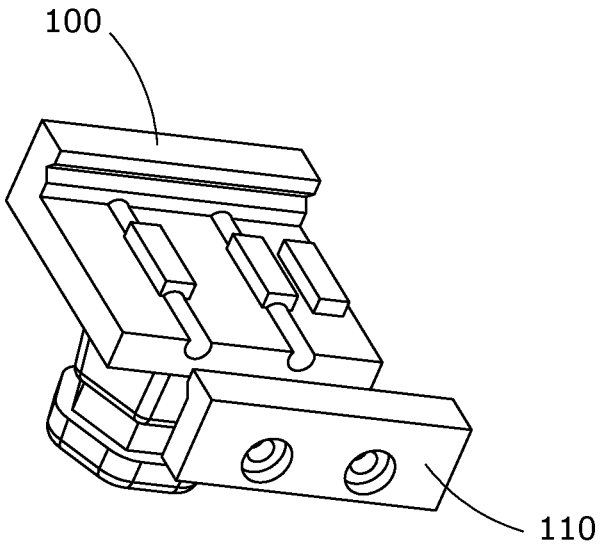
FIG. 3 is a perspective view of a mounting component.
Figure 4:
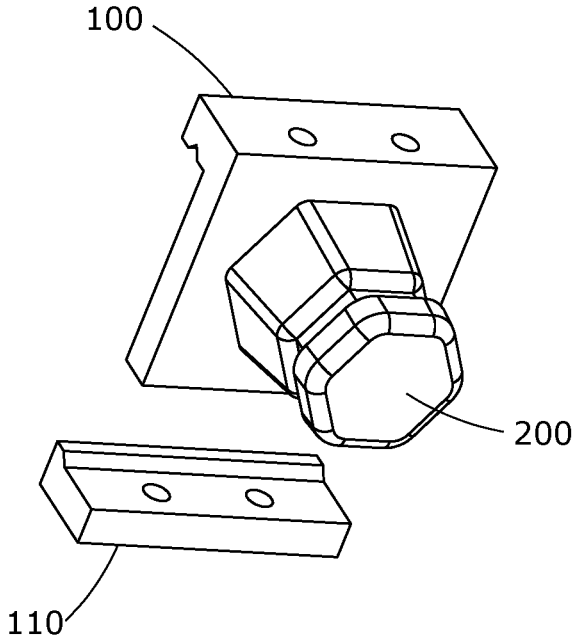
FIG. 4 is a perspective view of a mounting component.

Referring to FIG. 3 and FIG. 4, another embodiment of the mounting component 100 is illustrated. In this embodiment the connector 200 is a portion of the mounting component 100 and the two items are a single body.

Figure 5A:
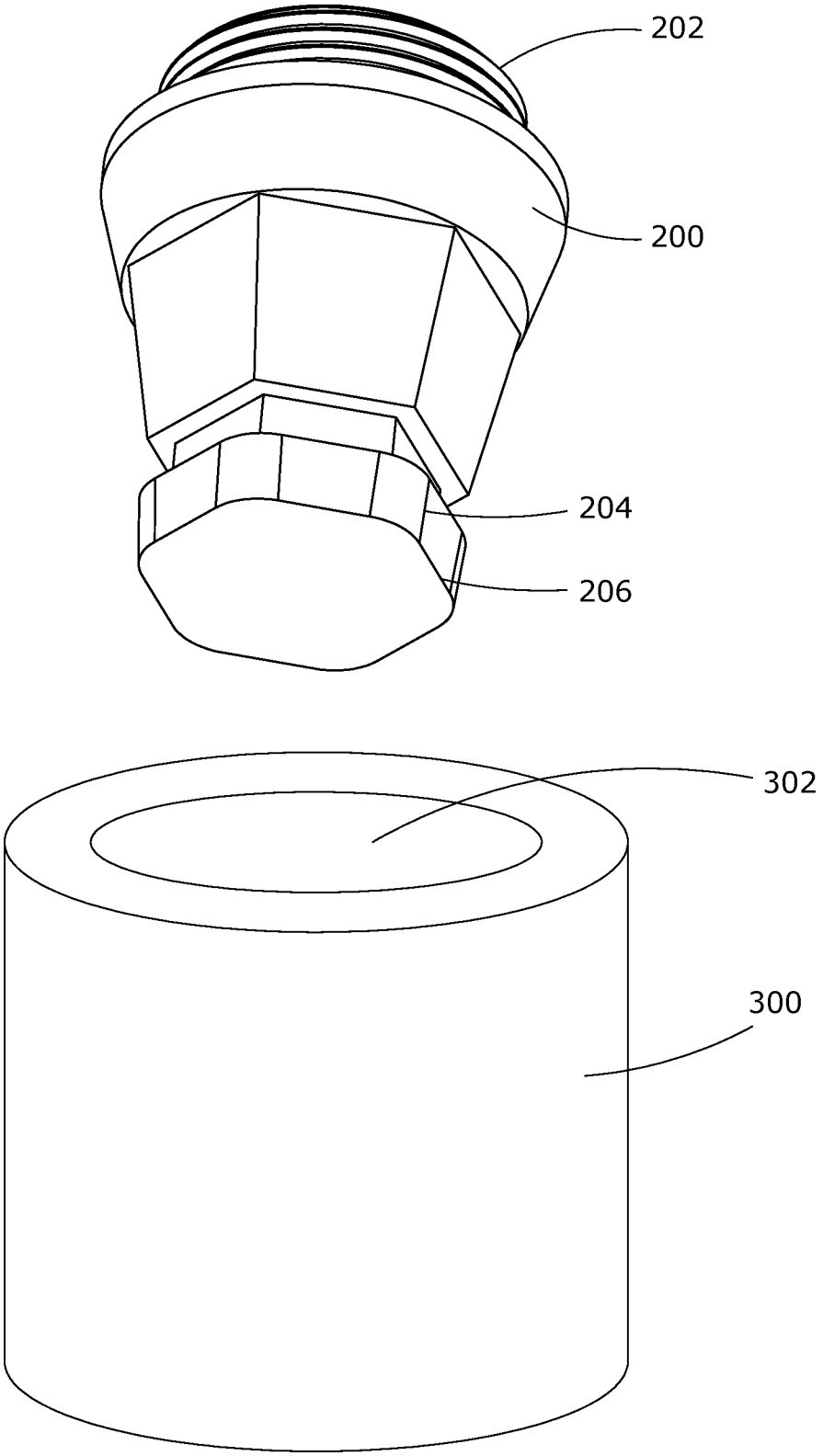
FIG. 5A is a side view of a connector and sleeve.
Figure 5B:
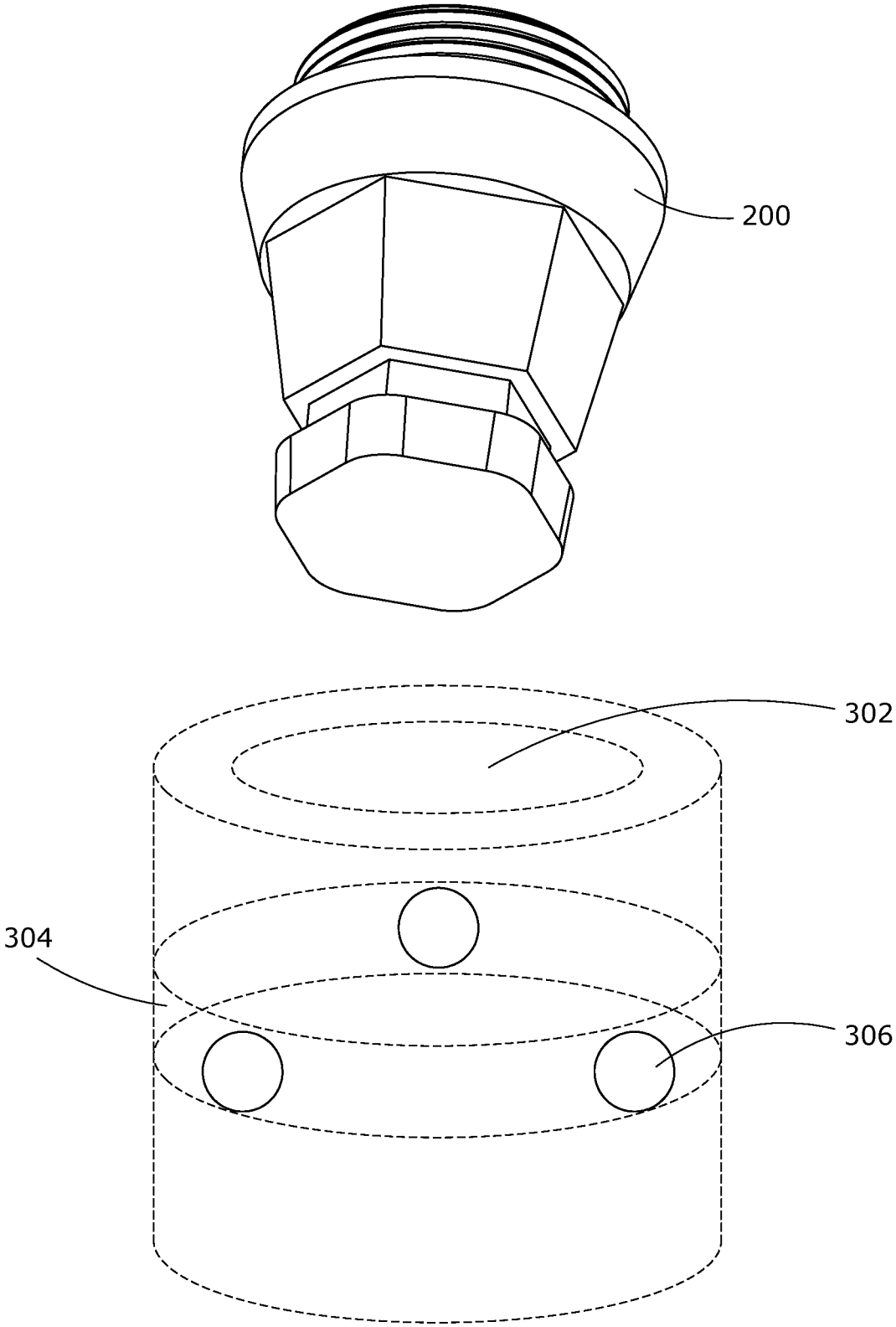
FIG. 5B is a side view of a connector and sleeve.

Referring to FIG. 5A and FIG. 5B, the preferred embodiment of the connector 200 and sleeve 300 are illustrated. In this embodiment, the connector 200 has a tapered shape with a smaller bottom end than the top end with the threading 202. At the bottom end of the connector 200 is a groove 204 and a lip 206. The connector 200 is configured to slide into a cavity 302 in the sleeve 300. The sleeve 300 may be any size and shape. When the connector 200 is inserted into the sleeve 300, the connector 200 is removably secured within the sleeve 300. Within the cavity 302 of the sleeve 300 is a ball bearing groove 304 containing one or more ball bearings 306. The ball bearings 304 fit within the groove 204 of the connector 200. When the ball bearings 306 are disposed within the groove 204 of the connector 200, the sleeve 300 is connected to the connector 200. To remove the sleeve 300 from the connector 200, the user may simply pull the connector 200 out of the sleeve 300. In other embodiments the sleeve 300 has an outer portion which is slid downward to allow the ball bearings 306 to retract out of the groove 204 of the connector 200.

The sleeve 300 may be any size and shape. The sleeve 300 may come in other configurations that do not utilize ball bearings 306. In these configurations the sleeve may have other internal protrusions which are retractable. The internal protrusions fit within the groove 204 of the connector 200 to retain the connector 200 within the cavity 302 of the sleeve 300. The internal protrusions may be on springs to force the internal protrusions into the groove 204. The internal protrusions can be removed from the groove 204 by sliding the outer portion of the sleeve 300 downward and away from the connector 200. When the internal protrusions or ball bearings 306 are retracted from the groove 204, the user can remove the connector 200 from the cavity 302 of the sleeve 300. The sleeve 300 can be connected to other components so that the connector 200 on the mounting component 100 can be connected to any type of component. In this manner a user may attach any type of component to the rail of the firearm.

Figure 6:
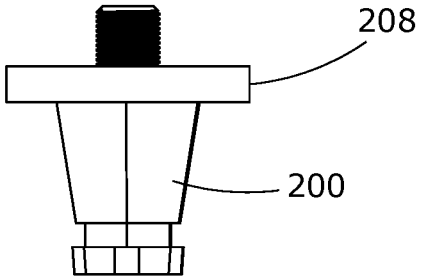
FIG. 6 is a side view of a connector.
Figure 7:
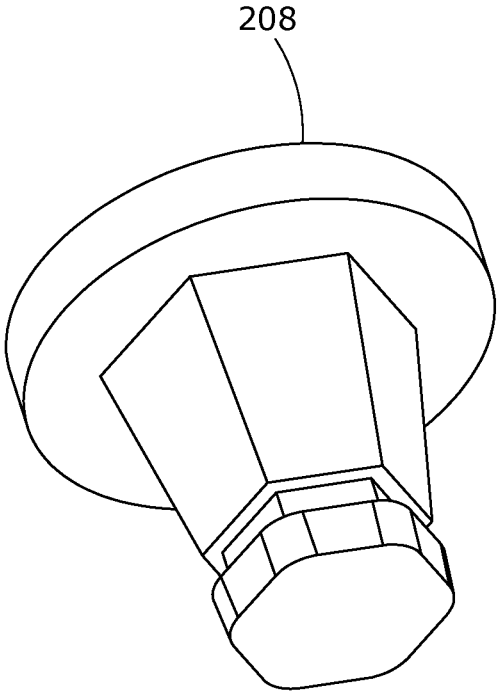
FIG. 7 is a perspective view of a connector.

Referring to FIG. 6 and FIG. 7, another embodiment of the connector 200 is illustrated. In this embodiment the connector 200 has a rim 208 at the top end of the connector 200 disposed adjacent to the threading 202. The embodiment of the connector illustrated in FIG. 6 and FIG. 7, the connector is a tripod to monopod adapter. This connector 200 illustrated screws into the bottom of a tripod 600 to convert the firearm from a lower shooting position to a higher shooting position.

Figure 8:
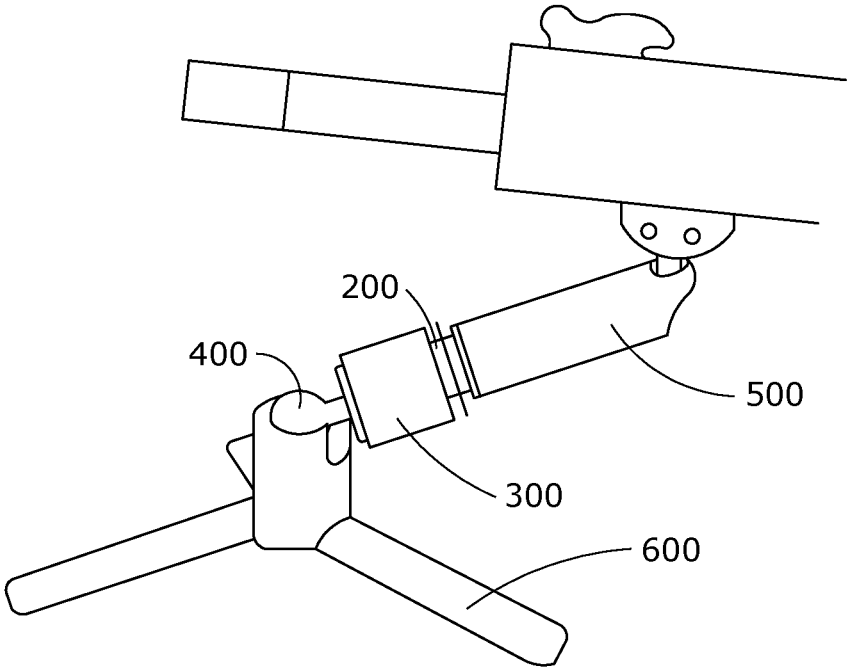
FIG. 8 is a side view of a firearm with the modular handle system.
Figure 9:
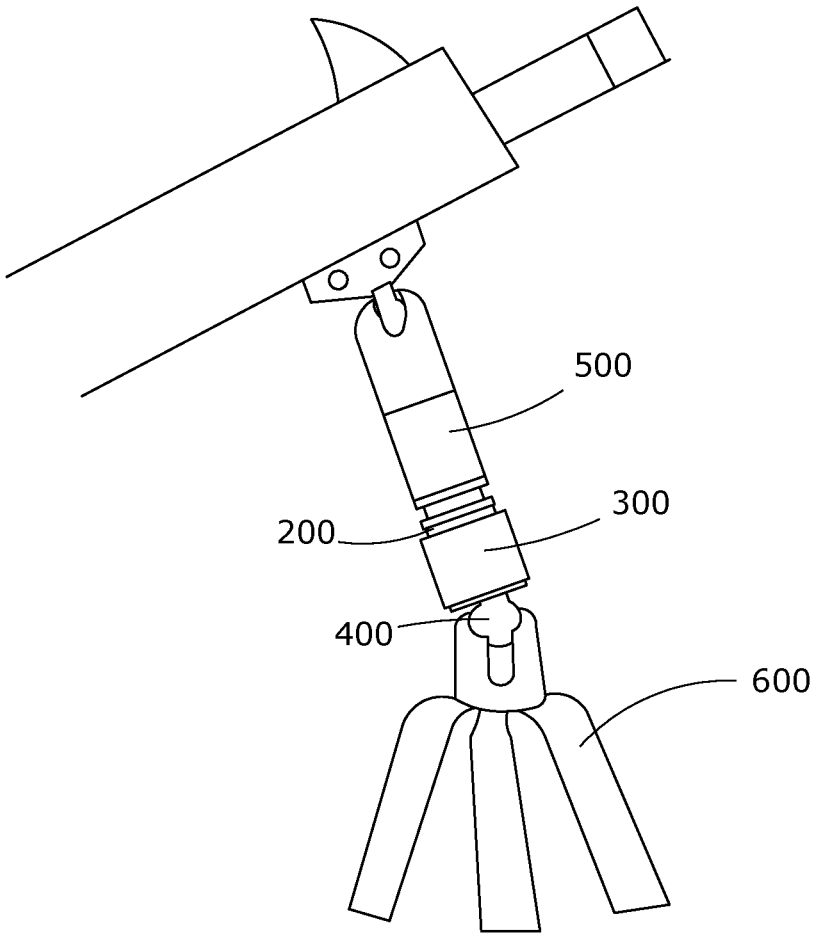
FIG. 9 is a side view of a firearm with the modular handle system.
Figure 10:
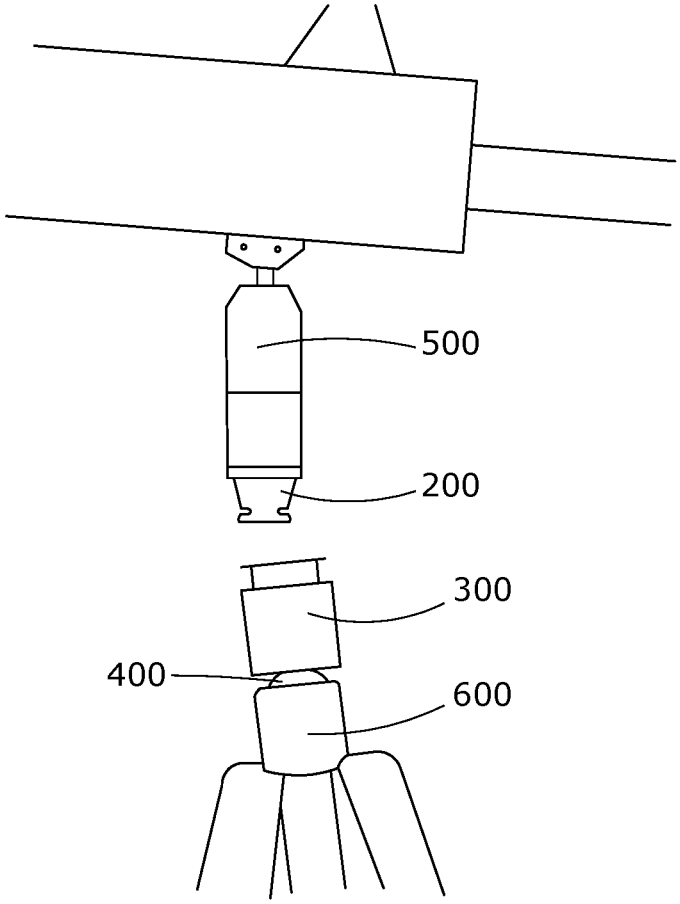
FIG. 10 is a side view of a firearm with the modular handle system.

Referring to FIGS. 8-10, the modular system is illustrated in use with a firearm. Shown in FIG. 8, the firearm is connected to a mounting component 100 which is connected pivotably to a handle 500. There is a pivot sphere 400 disposed between the handle 500 and the firearm. There is a second pivot sphere 400 disposed between the tripod 600 and the sleeve 300. The bottom end of the handle 500 is connected to a connector 200. The connector 200 is connected to a sleeve 300. The sleeve 300 is connected to the pivot sphere 400 which is connected to the tripod 600. The two pivot spheres 400 permits a user to pivot and maneuver the firearm in any position. As shown in FIG. 10, the firearm can be removed from the tripod 600 by removing the connector 200 from the sleeve 300. In this manner a user can shoot from a prone position with the firearm connected to a tripod 600 and then disconnect the firearm from the tripod 600 and stand up and maneuver to a new firing position.

Figure 11A:
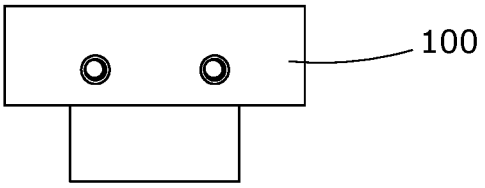
FIG. 11A is a side view of a mounting component.
Figure 11B:
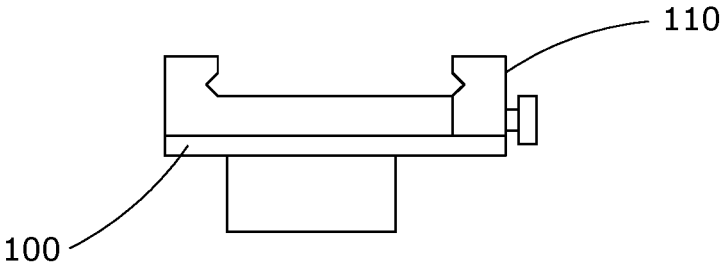
FIG. 11B is a side view of a mounting component.

Referring to FIG. 11A and FIG. 11B, another embodiment of the mounting component 100 is illustrated. In this embodiment the mounting component 100 can attach to a firearm that does not have a picatinny rail. The side plate 110 in this embodiment creates a force fit with the mounting component 100 on the firearm to mount the modular handle system to the firearm.

Figure 12:
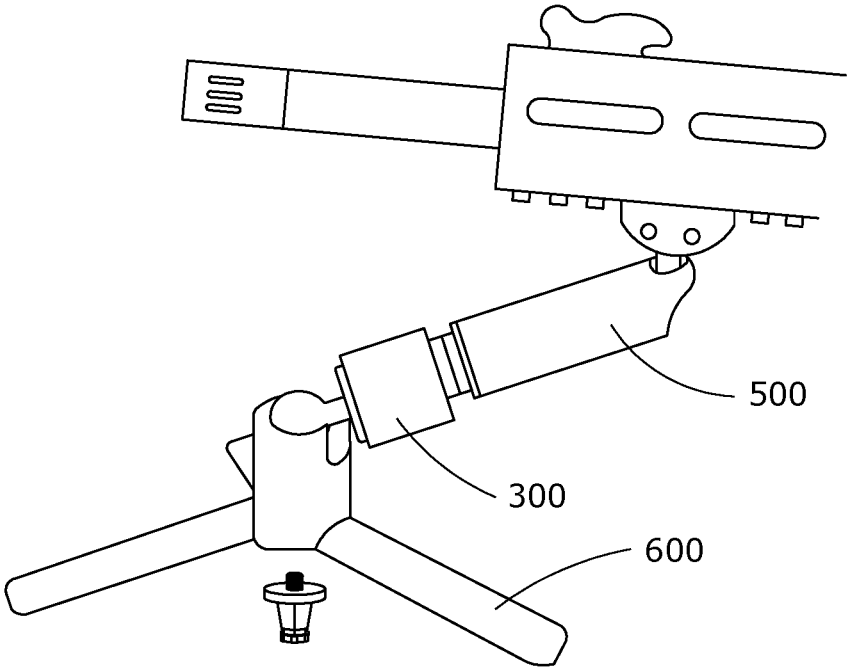
FIG. 12 is a side view of a firearm with the modular handle system.
Figure 13:
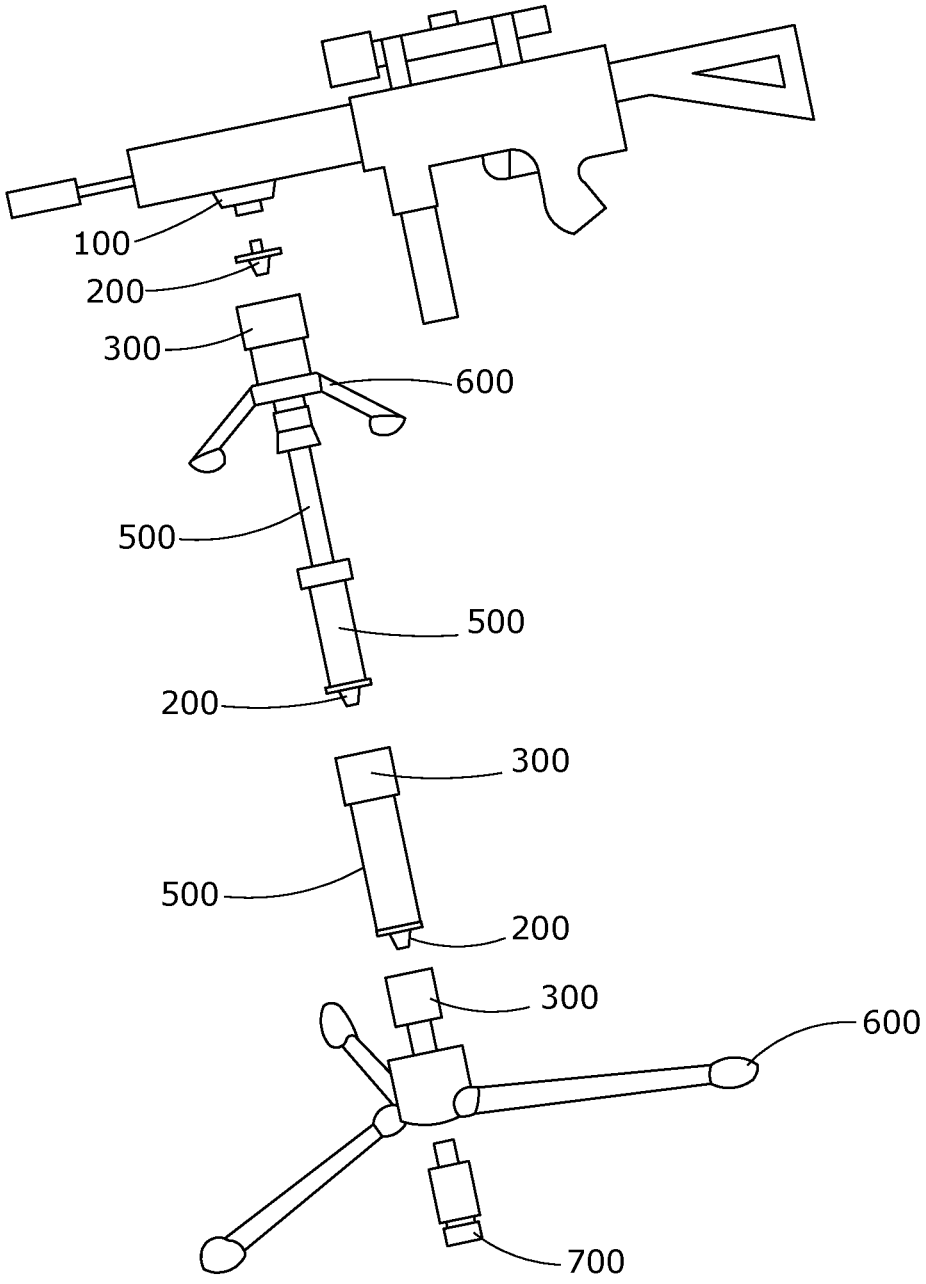
FIG. 13 is a side view of a firearm with the modular handle system.
Figure 14:
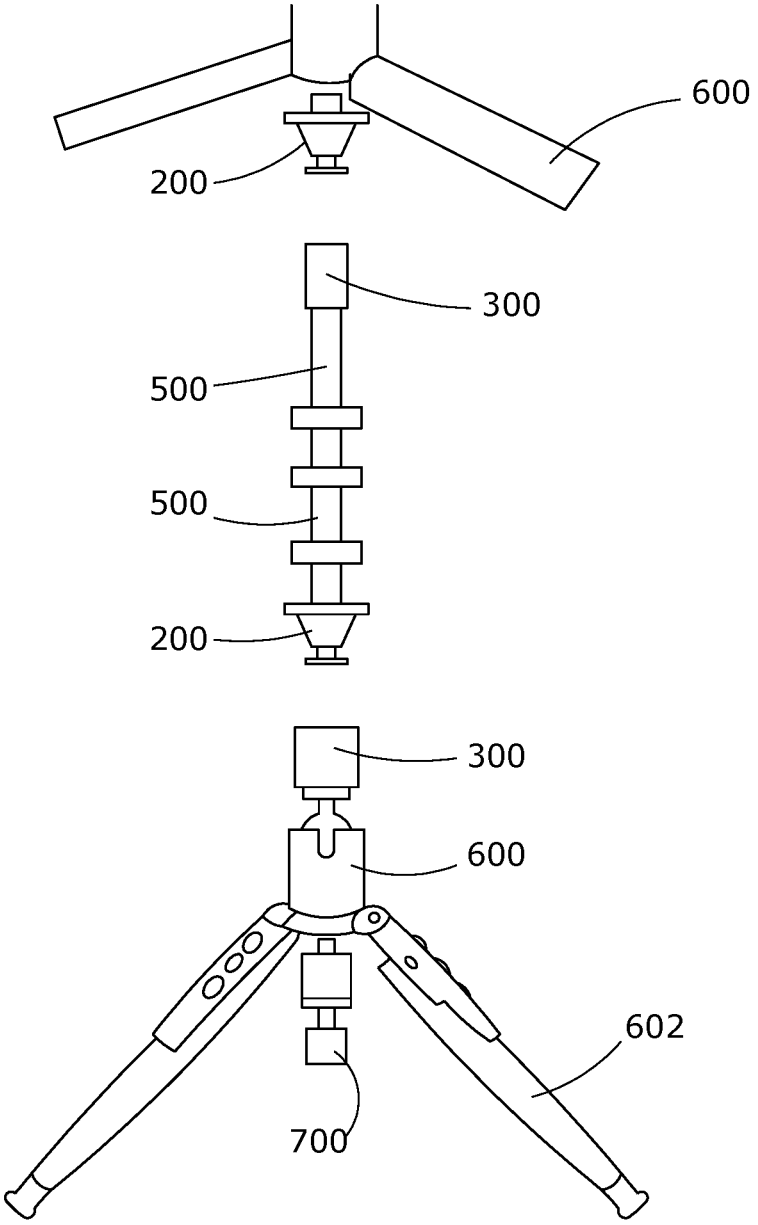
FIG. 14 is a side view of a firearm with the modular handle system.
Figure 15:
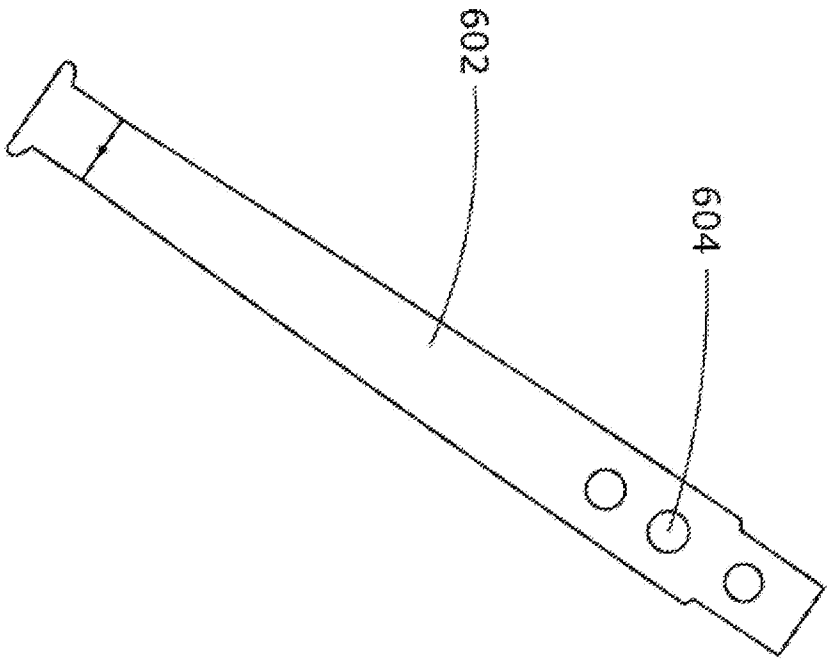
FIG. 15 is a side view of a leg extension.

Referring to FIGS. 12-14, the utilization of the modular mounting system is illustrated. In FIG. 12, the firearm is connected to a handle 500, which is connected to a tripod 600 by means of the connector 200 and sleeve 300. A user can attach to the bottom of the tripod 600 a connector 200 which is a tripod to monopod adaptor. As shown in FIG. 13, the firearm is connected a mounting component 100, which is connected to a connector 200. The connector 200 can be inserted into a sleeve 300 connected to a tripod 600. The tripod to monopod adaptor connector 200 is connected to a sleeve 300 which is connected to a handle. There may be multiple handles 500 connected in line by connectors 200 and sleeves 300. The bottom of a handle 500 may have flat bottom or a rubber base that allows the user to use the series of handles 500 as a monopod where the firearm is mounted on a stick and the user can rotate the firing direction. At the bottom may be a second tripod 600. Connected to the bottom of the tripod 600 may be a stabilizer 700. The stabilizer 700 is disposed downward from the tripod 600 to add a stability to the tripod 700. As shown in FIG. 14, the stabilizer 700 is best utilized when extension legs 602 are connected to a tripod 600. As shown in FIG. 15, the leg extension 600 is primarily an elongated member which attaches to the legs of a tripod 600. The leg extensions 602 can attach through the use of screws which pass through screw holes 604.

Figure 16:
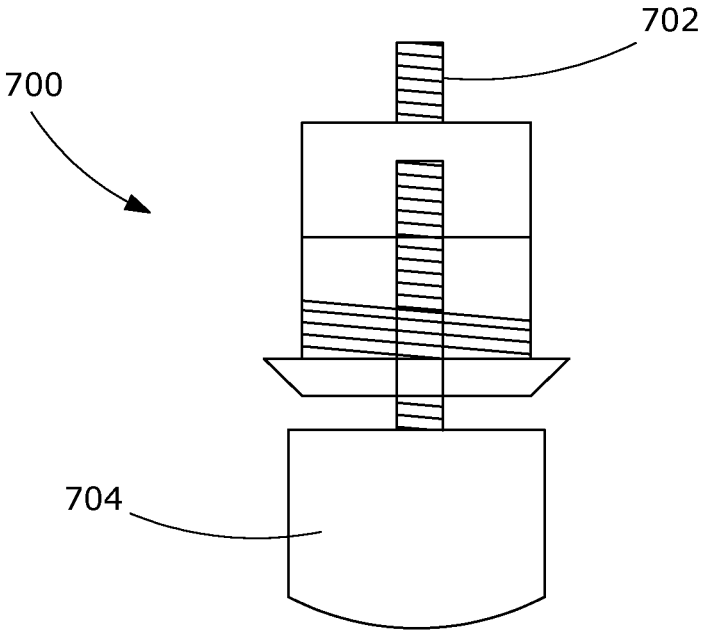
FIG. 16 is a side view of a stabilizer.
Figure 17:
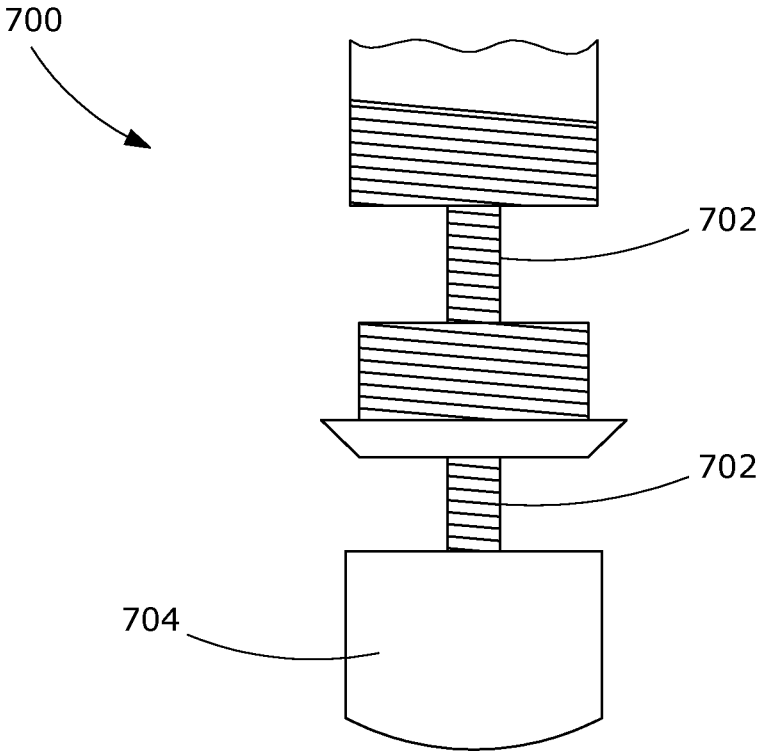
FIG. 17 is a side view of a stabilizer.

Referring to FIG. 16 and FIG. 17, the preferred embodiment of the stabilizer 700 is illustrated. The stabilizer 700 has a threaded screw 702 which can screw into the bottom of the tripod 600. The stabilizer may have multiple sections with threaded screws 702 which allows the stabilizer 700 to be extended and compressed to adjust the height. At the bottom of the stabilizer 700 is a rubber foot which engages the ground.

The modular handle components may be mixed and matched with multiple components being utilized. Any number of connectors 200 and sleeves 300 may be utilized to create a series of quickly interchangeable parts. These may be used to quickly interchange any number of components of the handle and change the configurations of the handle as needed.

Swivel Handle Components

The invention may be utilized with a friction fit swivel handle assembly as described in U.S. Pat. No. 9,718,182, the disclosure of which is hereby fully incorporated by reference. In this embodiment attached to the front rail of the firearm is a mounting component. Protruding from the mounting component is a ball. The ball fits within a handle extending downward from the firearm. At the top of the handle is a cut out which permits the handle to articulate about the ball. The handle may be locked into place by a friction pin or other component which creates a friction lock between the handle and the ball. At the bottom end of the handle is a second ball which may be detached from the handle. The ball is placed within a socket in the tripod base. The tripod base has a cut out which permits the ball to be positioned in any direction in the socket. The socket may have a locking pin which locks the ball into a fixed position. In other embodiments the ball extends from the tripod base and engages a socket in the handle.

The ball attachment may have a quick release component which allows for a user to quickly detach the handle from the ball component and use the firearm without the tripod. The quick release component may also be attached directly to a rail mount so that the user can utilize the tripod without the ball extension from the firearm.

The ball attachment system is similar in structure to the swivel handle assembly patented by Applicant and described as follows:

The swivel handle assembly comprises a friction pin, a ball attachment, a handle, a clamp base, a clamp, one or more bolts, a securing pin, and a fitting. The clamp base, clamp, and one or more bolts provide a means for attaching the swivel handle assembly to the rail of a firearm. The ball attachment is secured to the base clamp. The securing pin is inserted into a void in the clamp base to assist in holding the ball attachment into the clamp base. The handle is freely connected to the ball attachment at one end. The handle can swivel and tilt into any position and angle on the ball attachment. When the handle is placed in the desired position the user engages the friction pin. The friction pin enters the opposite end of the handle from the ball attachment. The friction pin engages one side of the fitting and forces the opposite side of the fitting to engage the ball attachment. When fully engaged, the fitting prevents the handle from being rotated to a new position.

When the friction pin is engaged the fitting extends through the internal cavity of the handle. The ball receiver of the fitting freely contacts the ball attachment.

The internal threading of the handle engages the external threading of the friction pin. When the threading is tightened the top end of the handle is pulled into the ball attachment and the ball receiver of the fitting is pushed into the ball attachment. The force exerted on the ball attachment creates a high frictional force between the handle and the ball attachment, essentially "locking" the handle in the desired position.

The fitting has a ball receiver which is shaped to fully engage the ball attachment. The ball receiver is a void in the top end of the fitting. The ball receiver may be any size, depth, and shape. The ball receiver may be a rounded, hemispherical surface or a wedge-shaped rim extending internally from the inner area of the fitting. The surface area presented by the ball receiver increases the frictional force between the fitting and the ball attachment. The void of the ball receiver may continue to extend through the body of the fitting to the bottom end. The fitting has a depression encircling the outer circumference of the fitting. The depression is an indentation into the body of the fitting configured to hold to a rubberized O-ring. The O-ring engages the inner surface of the hollow internal cavity of the handle to prevent the fitting from falling out of the hollow internal cavity when the friction pin is disengaged and removed.

The ball attachment has a first end with a ball. The ball is substantially spherical in shape. The ball is attached to a shaft. The shaft is a substantially cylindrical in shape and extends radially from the ball. The end of the shaft distal from the ball has external threading. The external threading permits the ball attachment to be removably secured to the clamp base. The shaft has a circular recess which extends inward around the outer circumference of the shaft.

The clamp base has a top surface. The top surface is configured to be positioned against the rail of the firearm. Opposite from the top surface is a receptor. The receptor is configured to receive shaft of the ball attachment. The receptor has a central opening for receiving the shaft of the ball attachment. The central opening has an internal threading which is complementary to the external threading of the ball attachment. The external threading of the ball attachment is threaded through the internal threading of the receptor to removably secure the ball attachment to the base clamp.

The top surface of the base clamp ha a notch. The notch runs longitudinally along the top end of the top surface. A portion of the clamp base extends vertically above the notch. The vertical portion of the base clamp is configured to receive and complement the rail of the firearm. When the clamp is attached to the clamp base, the rail is held within the notch. The top surface of the clamp base has one or more bolt recesses which traverse the longitudinal length of the clamp base. The bolt recesses permit are configured to receive the bolts and may have threading to secure the bolts to the base clamp. The base clamp has a pin receiver. The pin receiver is a circular void in the base clamp configured to hold the securing pin. The void of the pin receiver extends into the central opening to permit the securing pin to engage the shaft of the ball attachment. The top surface of the base clamp has a plurality of ridges. The plurality of ridges traverse the length of the base clamp and engage the slots of the rail of the firearm to prevent the base clamp from moving forward or backward along the length of the firearm.

The handle is a hollow elongated member in a substantially cylindrical shape. The handle has a top end and a bottom end. The top end of the handle has a notch. The notch is configured to permit the circular recess to enter the notch so that the handle can be folded upward and in line with the barrel of the rifle. The top end of the handle has a substantially circular opening which is smaller in circumference than the ball. The external surface of the lower end of the handle has a plurality of gripping ridges. The gripping ridges are vertical extensions encircling the outer circumference of the handle to permit a greater frictional grip of the handle by a user. In lieu of the gripping ridges, or in addition to the gripping ridges, the handle assembly may have a rubber or elastomeric sleeve fitting over the external surface of the handle. The handle has a hollow internal cavity extending the length of the handle. The lower internal surface of the internal cavity has an internal threading. The internal threading is configured to permit the friction pin to be removably secured to the handle.

The clamp is configured to complement the clamp base. The clamp is substantially the same length as the clamp base. The clamp has one or more bolt receptors. The bolt receptors are circular openings permitting the bolts to pass through to removably secure the clamp to the clamp base. The clamp has a ridge extending along the length of the clamp. The ridge is configured to complement the clamp base and secure the clamp base to the rail. The bolts removably secure the clamp to the clamp base in a way that the ridge is positioned above the rail to prevent the handle assembly from being removed from the rifle.

The friction pin is an elongate substantially cylindrical member configured to be received by the internal cavity of the handle. The friction pin may have a central opening in the body of the friction pin which may be used for the storage of personal items. One end of the friction pin terminates in a fitting receiver. The fitting receiver is a top edge at the distal end of the friction pin. The fitting receiver is configured to come into frictional contact with the fitting. When the friction pin is fully engaged with the handle the fitting receiver engages the fitting and pushes the fitting against the ball attachment. On the distal end from the fitting receiver, the friction pin has a grip. The grip extends radially from the outer circumference of the friction pin. On the friction pin is an external threading. The external threading is complementary to the internal threading of the handle.

The grip provides a means for the user to turn the friction pin radially within the handle. As the user turns the friction pin clockwise within the handle, the internal threading of the handle pulls the external threading of the friction pin inward into the internal cavity. This causes the fitting receiver of the friction pin to move inward within the internal cavity and press against the fitting. The user can rotate the friction pin to a sufficient degree that the fitting receiver presses the fitting against the ball to the point that the frictional force present cannot be overcome and the handle is substantially locked into place. If a user desires to change the position of the handle, the user rotates the friction pin in a counter clockwise manner. This causes the internal threading of the handle to push the external threading of the friction pin outward from the internal cavity. This causes the friction pin to move outward, relieving the pressure of the fitting receiver against the fitting and the ball. The user may then rotate the handle into any desired position. The user may rotate the handle into any desired position in line with the longitudinal axis of the firearm. Alternatively, the user may rotate the handle into any desired position radially on the ball attachment. The user may position the handle at an oblique angle out of line with the longitudinal axis of the firearm. The user then reengages the friction pin to push the fitting against the ball attachment to lock the handle in the chosen position.

In another embodiment the friction pin may have an end cap which can be removably secured to the lower end of the friction pin. The end cap has an end cap cavity for the storage of personal effects and items within the friction pin while using the firearm. The end cap cavity may be any size, shape, and dimension. The end cap has an external threading complementary to an internal threading of an internal cavity in the lower end of the friction pin. At the lower end of the end cap is an end cap grip. The end cap grip can be any size and shape but in the preferred embodiment the end cap grip is circular and coextensive with the outer circumference of the grip of the friction pin.

To utilize the storage in the end cap, a user places an item in the end cap cavity. The user then places the external threading of the end cap within the internal threading of the friction pin. The user holds the end cap grip and rotates the end cap axially, securing the end cap to the friction pin. To remove the item from storage in the end cap cavity, the user grasps the end cap grip and rotates the end cap axially in an opposite direction to disengage the external threading of the end cap from the internal threading of the friction pin.

In the preferred embodiment, the handle assembly may be removably secured to the Picatinny rail. A Picatinny mounting rail is typically placed in a parallel orientation to a weapon's receiver or barrel, or can be incorporated into a long arm's stock or a pistol frame. Accessories are typically clamped or attached to the rail by a combination of rigid and clamping members, affixed by screws, bolts, thumbscrews and/or cam levers that index into transverse slots that repeat for the length of the rail at a precise uniform spacing. A Picatinny rail, which is also sometimes called a tactical rail, is a standard bracket that is used on some firearms that provides a standardized mounting platform for accessories. Picatinny rails are used on many different types of firearms and were originally designed for mounting scopes. However, the rails are useful for mounting any number of different types of accessories, including but not limited to accessories such as optics, sighting telescopes, laser aiming modules, thermal imaging devices, night vision devises, knives, cameras, flashlights, foregrips, bipods, bayonets, and the like. The rail is a longitudinal member that is mounted to the weapon. The rail includes opposed side edges with a specific configuration and a series of ridges extending transverse to the longitudinal axis of the member; each ridge is separated from adjacent ridges with a spacing slot. The rails typically have very standardized size and spacing specifications.

In another embodiment the swivel handle assembly is permanently attached to the forward rail of a firearm. In this embodiment the forward rail of the firearm is manufactured to have a ball attachment permanently connected to the forward rail. In this embodiment the ball attachment would not have any ball attachment external threading. Also the swivel handle assembly would comprise solely the ball attachment, handle, fitting, and friction pin.

The components of the swivel handle assembly may be made from any type of material, such as a metal or a thermoplastic. Any external coverings for the swivel handle assembly, including but not limited to the sleeve fitting over the external surface of the handle may be made from any type of material. In the preferred embodiment, external coverings will be composed of rubber, synthetic rubber, an elastomer, leather, fabric, or any other type of material used for an external covering.

In the preferred embodiment the swivel handle assembly is utilized for a firearm. However, in other embodiments of the invention the swivel handle assembly can be used for any device. For instance, the swivel handle assembly may be attached to a hose or a firehose to permit a user to hold the hose while in use. Alternatively the swivel handle assembly may be used on a tool, such as a drill, or a gardening device such as a mower. The swivel handle assembly may be attached to steering wheels or columns for the operation of a vehicle. The swivel handle assembly may be utilized on any device, tool, or component, which a user must grip and hold to utilize or carry. The swivel handle assembly may be utilized as an accessory to an existing device, configured to be removed and attached at will by the user. Alternatively, the swivel handle assembly may be permanently attached to the device at the original point of manufacture.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A modular handle system for a firearm comprising
- a) a mounting component configured to be removably secured to a firearm;
- b) one or more connectors, wherein each of said one or more connectors comprise
  - i) a first end and a second end;
  - ii) a channel disposed adjacent to said second end;
  - iii) wherein said second end terminates in a lip;
- c) one or more sleeves, wherein each of said one or more sleeves comprise
  - i) an internal cavity;
  - ii) one or more internal protrusions disposed into said internal cavity
- d) wherein said one or more internal protrusions are respectively disposed in said channel of said one or more connectors when said connector is disposed in said internal cavity of said sleeve.

2. The modular handle system as in claim 1 further comprising a pivot sphere connected to a portion of said modular handle system.

3. The modular handle system as in claim 2 wherein said pivot sphere is connected to said mounting component.

4. The modular handle system as in claim 1 further comprising a handle connected to a portion of said modular handle system.

5. The modular handle system as in claim 4 wherein said one or more connectors further comprises a connector attached to an end of said handle.

6. The modular handle system as in claim 5 wherein said one or more sleeves further comprises a first sleeve attached to pivot sphere.

7. The module handle system as in claim 1 further comprising a tripod connected to a portion of said modular handle system.

8. The module handle system as in claim 7 further comprising one or more leg extensions connected to said tripod.

9. The module handle system as in claim 7 further comprising a stabilizer connected to a bottom portion of said tripod.

10. The module handle system as in claim 1 further comprising a handle connected to a portion of said modular handle system
- a) wherein said one or more connectors further comprises a first connector having a threaded first end;
- b) wherein said mounting component has a threaded portion for receiving said threaded first end of said first connector;
- c) wherein said first connector is removably attached to said mounting component.

11. The module handle system as in claim 1 further comprising a side plate attached to said mounting component.

12. The modular handle system as in claim 1 wherein said one or more internal protrusions further comprise ball bearings.

13. A firearm containing a modular handle system comprising a) a firearm;

b) a mounting component removably secured to said firearm;

c) one or more connectors, wherein each of said one or more connectors comprise i) a first end and a second end;

ii) a channel disposed adjacent to said second end;

iii) wherein said second end terminates in a lip;

d) one or more sleeves, wherein each of said one or more sleeves comprise i) an internal cavity;

ii) one or more internal protrusions disposed into said internal cavity e) wherein said one or more internal protrusions are respectively disposed in said channel of said one or more connectors when said connector is disposed in said internal cavity of said sleeve.

14. A method for rearranging a configuration of a modular handle system for a firearm, wherein said modular handle system comprises a) a mounting component configured to be removably secured to a firearm;

b) one or more connectors, wherein each of said one or more connectors comprise i) a first end and a second end;

ii) a channel disposed adjacent to said second end;

iii) wherein said second end terminates in a lip;

c) one or more sleeves, wherein each of said one or more sleeves comprise i) an internal cavity;

ii) one or more internal protrusions disposed into said internal cavity d) wherein said one or more internal protrusions are respectively disposed in said channel of said one or more connectors when said connector is disposed in said internal cavity of said sleeve;

e) wherein said method further comprises i) inserting a first connector into a first sleeve;

ii) removing said first connector from said first sleeve;

iii) inserting said first connector into a second sleeve; and iv) firing said firearm.

* * * * *